United States Patent [19]

Perrin

[11] 4,369,741

[45] Jan. 25, 1983

[54] DEVICE FOR AUTOMATICALLY CONTROLLING THE CLOSURE OF THE DECOMPRESSION VALVE OF AN INTERNAL COMBUSTION ENGINE

[75] Inventor: Marc Perrin, Genlis-Pluvault, France

[73] Assignee: Cycles Peugeot, Valentigney, France

[21] Appl. No.: 212,307

[22] Filed: Dec. 3, 1980

[30] Foreign Application Priority Data

Dec. 14, 1979 [FR] France ..... 79 30752

[51] Int. Cl.[3] ..... F01L 13/08

[52] U.S. Cl. ..... 123/182

[58] Field of Search ..... 123/182, 150, 198 F

[56] References Cited

U.S. PATENT DOCUMENTS

| | | | |
|---|---|---|---|
| 1,749,152 | 3/1930 | Müller | 123/182 |
| 2,947,300 | 8/1960 | Trapp | 123/182 |
| 4,185,606 | 1/1980 | Miyata | 123/182 |

FOREIGN PATENT DOCUMENTS

| | | | |
|---|---|---|---|
| 347553 | 4/1931 | United Kingdom | 123/182 |

*Primary Examiner*—Charles J. Myhre

*Assistant Examiner*—Andrew M. Dolinar

*Attorney, Agent, or Firm*—Sughrue, Mion, Zinn, Macpeak and Seas

[57] ABSTRACT

The device comprises a conventional arrangement for opening the decompression valve comprising a manual actuating lever connected to the valve and operative to open the valve in opposition to the action of a return spring which biases the valve to the closing position. A delay device is provided for delaying the return of the valve to the closing position when the actuating lever has been released. The delay device comprises a control member connected to the connection between the actuating lever and the valve and movable substantially in a plane between a first position for opening the valve and a second position for closing the valve. A finger member pivotally mounted on the control member is positioned to engage a helical groove on a shaft rotated by the engine when starting up and is blocked by the shaft until the finger member has travelled to the end of the helical groove and reached the outer extremity of the shaft whereupon it suddenly ceases to be blocked by the shaft and the control member can move to its second position and suddenly close the valve.

7 Claims, 5 Drawing Figures

DEVICE FOR AUTOMATICALLY CONTROLLING THE CLOSURE OF THE DECOMPRESSION VALVE OF AN INTERNAL COMBUSTION ENGINE

DESCRIPTION

The starting up of small internal combustion engines employed for example on two-wheeled vehicles, such as mopeds, is mostly achieved by means of the pedal crank-gear with which the vehicle is usually equipped. Thereafter, it is the muscular power of the driver which ensures the initial cranking of the engine. Now, very often, and particularly when the driver is a woman or a child, this force is insufficient to cause the rotation of the engine.

Consequently, most engines of this type have been provided with a decompression valve whereby it is posisble to put the combustion chamber of the engine in communication with the atmosphere. In this way, compression of the gases is avoided and the first few rotations of the engine occur without difficulty. However, this valve must suddenly close as soon as the speed of rotation of the engine is sufficient to enable the engine to start up normally. Now, the opening and closing of the decompression valve are controlled by the driver, usually by means of a control lever mounted on the handlebar. Consequently, the driver must act with much dexterity and in perfect synchronism with the rotation of the engine, for example effected by means of the crank-gear.

An object of the present invention is to avoid this by providing an automatic control which closes the decompression valve with precision after a given number of rotations or revolutions of the engine.

According to the invention, there is provided a control device for automatically closing the decompression valve, said device comprising a pivotal finger member which pivots laterally under the opposed actions of a decompression control and a return spring of the valve returning the latter to the closing position, and which thus in succession cooperates with a helical groove formed in the end portion of a shaft connected to rotate with the engine so as to prevent the action of the return spring, and then overlaps the end of said shaft and releases the spring and causes the closure of the valve.

In the position of rest, i.e. when the decompression control is not actuated, the finger member overlaps the end of the shaft and is consequently free to pivot.

On the other hand, as soon as the decompression control becomes active, it pivots the finger member and puts it in contact with the helical groove. It is only when it has travelled through the whole of this groove and has reached the end of the shaft that it is able to once again pivot in the opposite direction and resume its position of rest which causes the sudden closure of the valve.

The ensuing description of one embodiment given merely by way of example and shown in the accompanying drawings will further bring out the features and advantages of the invention.

Figure 1:
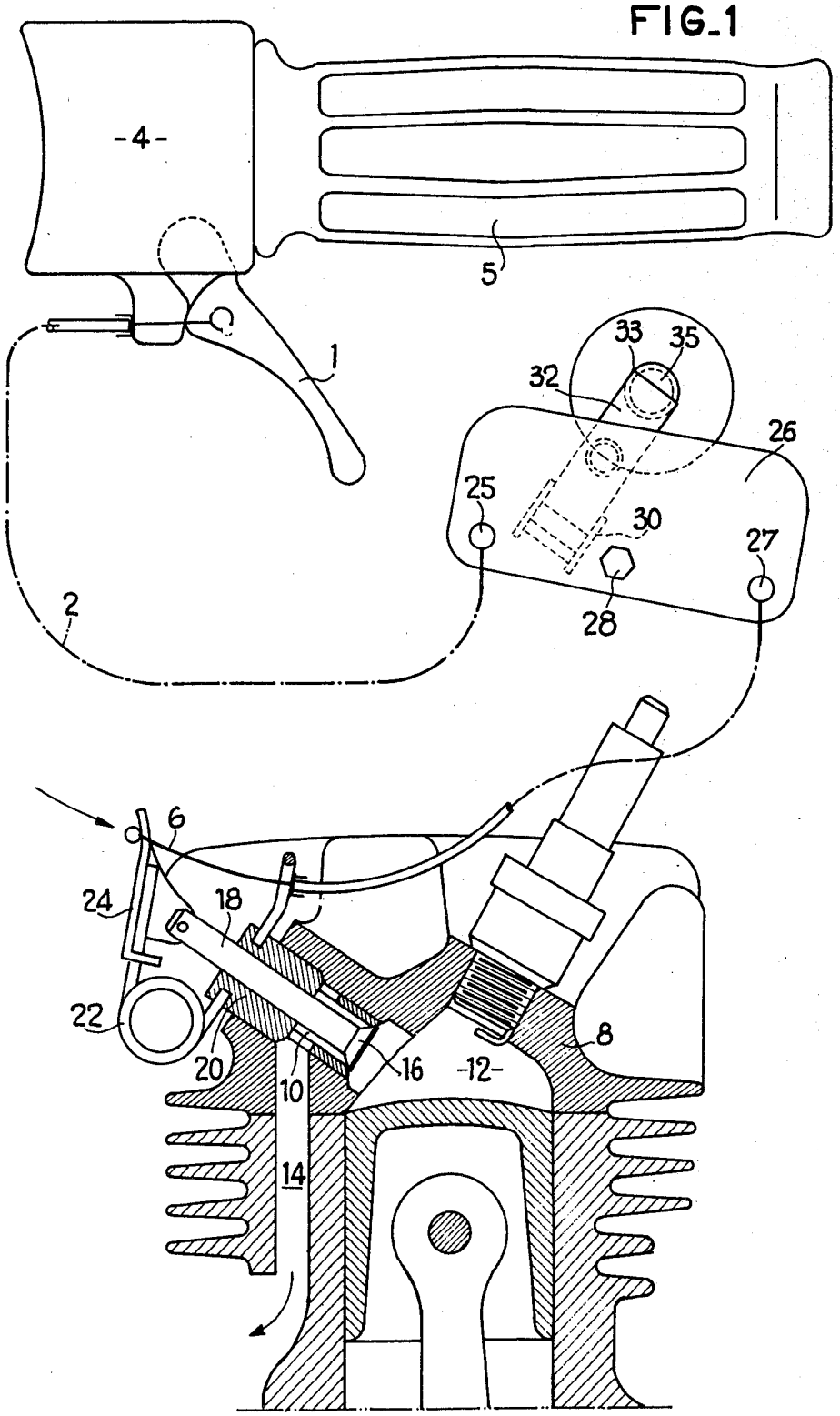
FIG. 1 is a diagrammatic view of the control device according to the invention in the position thereof corresponding to the closure of the valve, the cylinder head of the engine being shown in axial section.

As shown in FIG. 1, the device controlling the decompression valve of an internal combustion engine mounted on a moped or the like, comprises a lever 1 which acts on a cable 2 and is pivotally mounted on the handlebar 4 of the vehicle in the vicinity of a control grip 5. In the same way, the valve, or more precisely the spring which returns the valve to the closing position thereof, is connected to a control cable 6.

Indeed, the cylinder head 8 of the engine is provided with a bore 10 which communicates with the combustion chamber 12 and with a passageway 14 leading to the atmosphere. The communication between the bore 10 and the combustion chamber 12 is controlled by a valve 16 which is rigid with a rod 18 slidable in a guide 20 which is rigid with the cylinder head 8. A hairpin-shaped spring 22 is interposed between the guide 20 and a lever 24 which is connected, on one hand, to the end of the rod 18 and, on the other hand, to the end of the cable 6. As shown in FIG. 1, the spring 22 thus constantly urges the valve 16 toward the closing position thereof.

The two control cables 2 and 6 are fixed to the two ends 25 and 27 respectively of a control member or plate 26 which is pivotable, while remaining parallel to itself, about means defining an axis 28 placed midway between the two points 25 and 27.

Figure 2:
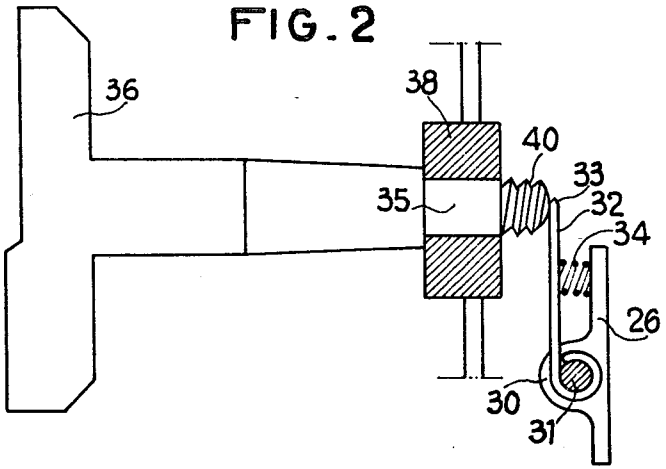
FIG. 2 is a side view, with a part cut away, of the pivotal system in the position corresponding to the closure of the valve.

On one of its sides, the plate 26 carries a fork 30 through which extends a pin 31 on which a finger member 32 is pivotally mounted (FIG. 2). A spring 34 bears, on one hand, against the plate 26 and, on the other hand, against the finger member 32 and tends to move these two members away from each other.

In the position of rest, i.e. in the position corresponding to the closure of the decompression valve 16, the finger member 32 bears against the end of a shaft 35 which is connected to rotate with the engine. For example, in the illustrated embodiment, this shaft 35 is formed by an extension of the crankshaft 36 of the engine. This shaft 35 is carried by a fixed bearing 38 and has, between the latter and the end thereof, a helical groove 40 which may for example constitute a screwthread.

Figure 5:
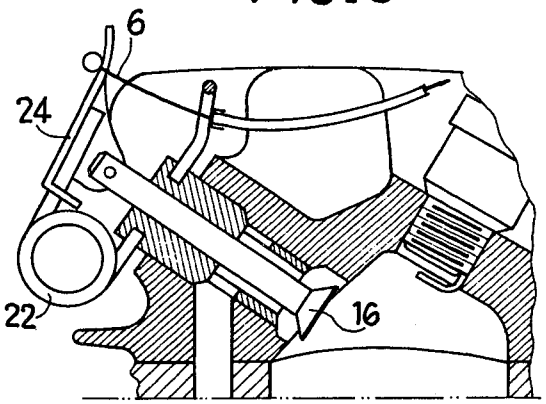

When, when starting up, the driver acts on the lever 1 and consequently pulls on the cable 2, he causes the plate 26 to laterally pivot about the axis 28. The finger member 32 is driven in this pivoting motion and also pivots about the axis 28. Consequently, the end portion 33 of this finger member 32 which overlapped the end of the shaft 35 is laterally disengaged from this shaft and consequently is urged by the spring 34 into contact with the bearing 38, i.e. to the end of the helical groove 40. The pivoting of the plate 26 has exerted a pull on the cable 6 and thus caused the branches of the spring 22 to move toward each other, i.e. caused the opening of the valve 16 (FIG. 5).

However, the branches of the spring 22 always tend to move away from each other and consequently close the valve 16 and pull on the cable 6 to cause the plate 26 to pivot in the clockwise direction as viewed in FIGS.

1 to 4. This pivoting is however rendered impossible by the contact of the end portion 33 of the finger member 32 with the shaft 35, or more precisely, the groove 40. Even if the lever 1 is released by the driver, there is no danger of the plate 26 pivoting.

Figure 3:
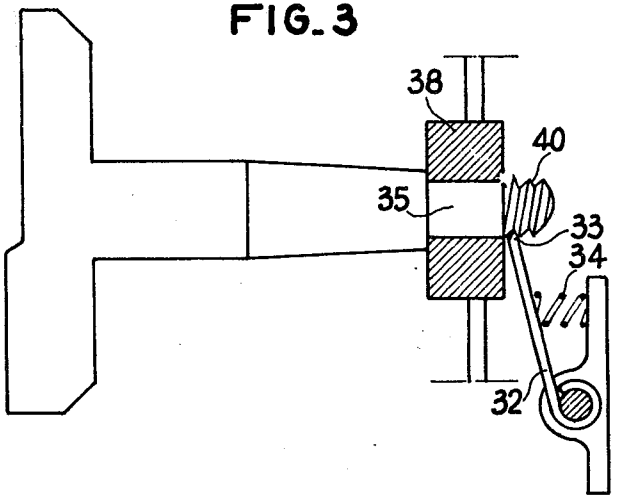
FIGS. 3 and 4 are respectively a side view with a part cut away and a front view of the pivotal system in the position corresponding to the opening of the valve, and, FIG. 5 is a partial longitudinal sectional view of the cylinder head of the engine with the decompression valve in the open position thereof.

On the other hand, when the driver actuates the pedal crank-gear and thus rotates the engine, this rotation is facilitated by the opening of the decompression valve. Further, as the shaft 35 is connected to rotate with the engine, it being for example rigid with the crankshaft 36 as shown in FIGS. 2 and 3, it is driven in rotation by the action on the crankgear. The helical groove 40 also starts to rotate and causes the end portion 33 of the finger member 32 to move through the successive turns of this groove.

At the end of its travel, the end portion 33 reaches the outer extremity of the shaft 35 and suddenly ceases to be blocked by the shaft. Thereafter, there is nothing to oppose the force exerted on the cable 6 by the spring 22 so that the plate 26 pivots laterally and the valve 16 is suddenly closed.

In view of the fact that, before permitting this sudden closure, the finger member 32 had to travel through all the turns of the helical groove 40, the engine had automatically effected a given number of rotations before the closure of the valve 16. A suitable choice of the number of turns of the helical groove 40 enables the engine to effect, before the closure of the valve 16, a sufficient number of rotations for the cranking thereof so that it can thereafter easily start up.

Figure 4:
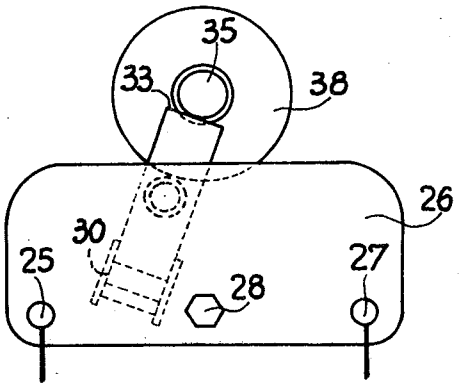

Preferably, as shown in particular in FIGS. 1 and 4, the fork 30 supporting the finger member 32 is located at a point intermediate between the axis 28 of the plate 26 and the point 25 at which the cable 2 is fixed. In this way, the end portion 33 of the finger member 32 comes in contact with the groove 40 at a point which is also located on the same side as the point 25 of a plane containing the pivot axis 28 and the axis of the shaft 35. Any pivoting of the plate 26 toward the cable 6 is thus completely inhibited so long as the engine has not effected the required number of rotations.

Owing to such a device, the driver is absolutely sure that the decompression valve will be closed exactly at the required moment and he has no particular movement to effect, merely the actuation of the lever 1 automatically resulting in the opening and then the closure of this valve.

Note moreover that the control device arranged in this way is extremely simple while perfectly reliable, which renders it particularly adapted to mopeds or other two-wheeled vehicles.

Having now described my invention what I claim as new and desire to secure by Letters Patent is:

1. In a device for automatically ceasing the decompression of an internal combustion engine and comprising a decompression valve for the engine, which valve has a closing position and an opening position, a return spring combined with the valve for urging the valve to said closing position, manual actuating means movable between a closed valve position and an open valve position for shifting the valve to said opening position thereof in opposition to the effect of the spring, connecting means connecting the actuating means to the valve; the improvement comprising delay means for delaying the return of the valve to said closing position of the valve by the effect of said return spring when said actuating means is moved to said closed valve position, said delay means comprising a control member connected to the connecting means and movable by the connecting means substantially in a plane between a first position in which the valve is in the said opening position and a second position in which the valve is in said closing position, said spring being operative to bias the control member toward said second position, a finger member mounted on the control member to move transversely of said plane, a shaft for rotation by said engine when cranking the engine and defining a helical groove leading to an outer extremity of the shaft, the shaft being so positioned relative to the control member that the control member, in moving in a direction from said first position to said second position under the action of said spring, is operative to move the finger member toward and into lateral engagement with said helical groove so that the movement of the control member to said second position to close the valve is blocked by said shaft and delayed until the finger member has travelled longitudinally along the shaft in the helical groove as the shaft rotates upon cranking the engine and has reached the outer extremity of the shaft, whereupon the finger member suddenly ceases to be blocked by said shaft and is free to move laterally beyond the shaft and allows the control member to move to said second position and suddenly close the valve.

2. A device as claimed in claim 1, wherein, in a position of rest of the device, when the actuating means has been put in said closed valve position by the action of said spring, the finger member is adjacent said outer extremity of the shaft and is unobstructed by the shaft and the control member is free to pivot in said plane.

3. A device as claimed in claim 1 or 2, wherein a second spring is interposed between the finger member and the control member and constantly biases the finger member in a direction substantially parallel to the axis of rotation of the shaft toward an end of the helical groove remote from said outer extremity of the shaft.

4. A device as claimed in claim 1, wherein the control member is a plate which is capable of laterally pivoting in the plane of the plate about a pivot axis and the plate is connected on each side of said pivot axis respectively to said valve and to the actuating means.

5. A device as claimed in claim 4, wherein the finger member is pivotally mounted on the plate between said pivot axis and the connection of the plate to the actuating means.

6. A device as claimed in claim 1, wherein the helical groove is a screw thread.

7. A device as claimed in claim 1, comprising cables which connect the control member to said valve and to said actuating means.

* * * * *